United States Patent [19]

Draper, Jr.

[11] 4,180,949

[45] Jan. 1, 1980

[54] TRANSPORTABLE-EXPANDABLE MOBILE HOME STRUCTURE

[76] Inventor: Earle S. Draper, Jr., 2020 Randolph Rd., Charlotte, N.C. 28207

[21] Appl. No.: 922,632

[22] Filed: Jul. 7, 1978

[51] Int. Cl.[2] ..... E04B 1/344; B06P 3/34

[52] U.S. Cl. ..... 52/67; 52/71

[58] Field of Search ..... 296/23 C, 23 R, 23 G; 52/67, 66, 69, 71

[56] References Cited

U.S. PATENT DOCUMENTS

| | | | |
|---|---|---|---|
| 3,288,521 | 11/1966 | Patnode | 52/66 |
| 3,429,608 | 2/1969 | Farnum | 296/23 R |
| 3,653,165 | 4/1972 | West | 52/69 |
| 3,941,414 | 3/1976 | Platt | 296/23 G |
| 4,000,588 | 1/1977 | Vanderlely | 52/71 |

*Primary Examiner*—John E. Murtagh

*Attorney, Agent, or Firm*—Richards, Shefte & Pinckney

[57] ABSTRACT

A mobile home for retracted transport and expanded occupancy, such mobile home having a roof structure including two roof portions, each roof portion having an element mounted for transverse movement with respect to the body portion of the mobile home between a retracted position for transport and an extended position at which the element overhangs the body portion to form an eave beneath the roof structure. The element for transverse movement is hinged adjacent its outer end to a second element of each roof portion adjacent the lower edge of the roof structure so that the second elements may be unfolded upwardly for joining at their upper extending ends when the first elements are extended, thereby forming a raised roof configuration. Suitable expansion units are selectively mounted beneath the eaves of the expanded roof structure contiguous to the outside of the body portion for the expanded occupancy, and these expansion units may be carried within the body portion for transport while the roof portion first elements are contracted and the second elements are folded down to lie generally flat across the body portion in an overlapping relation. The second roof elements are shaped to form a truncated ridge roof structure when expanded, and a detachable elongated roof peak portion housing a solar energy collector is mounted atop the truncated structure and overlaps it suitably for weather-tightness.

7 Claims, 6 Drawing Figures

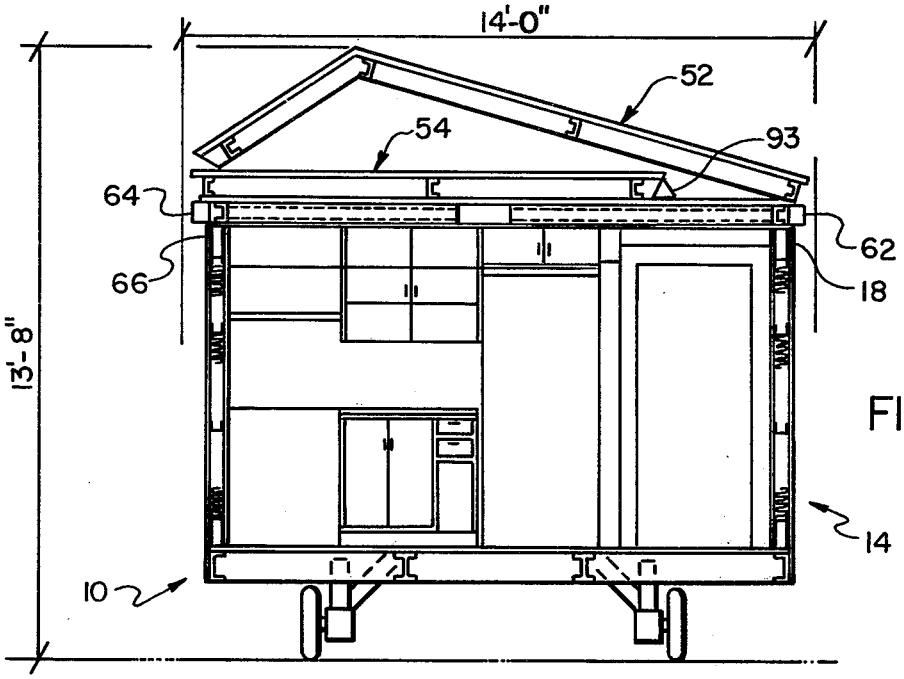
FIG. 5
FIG. 4
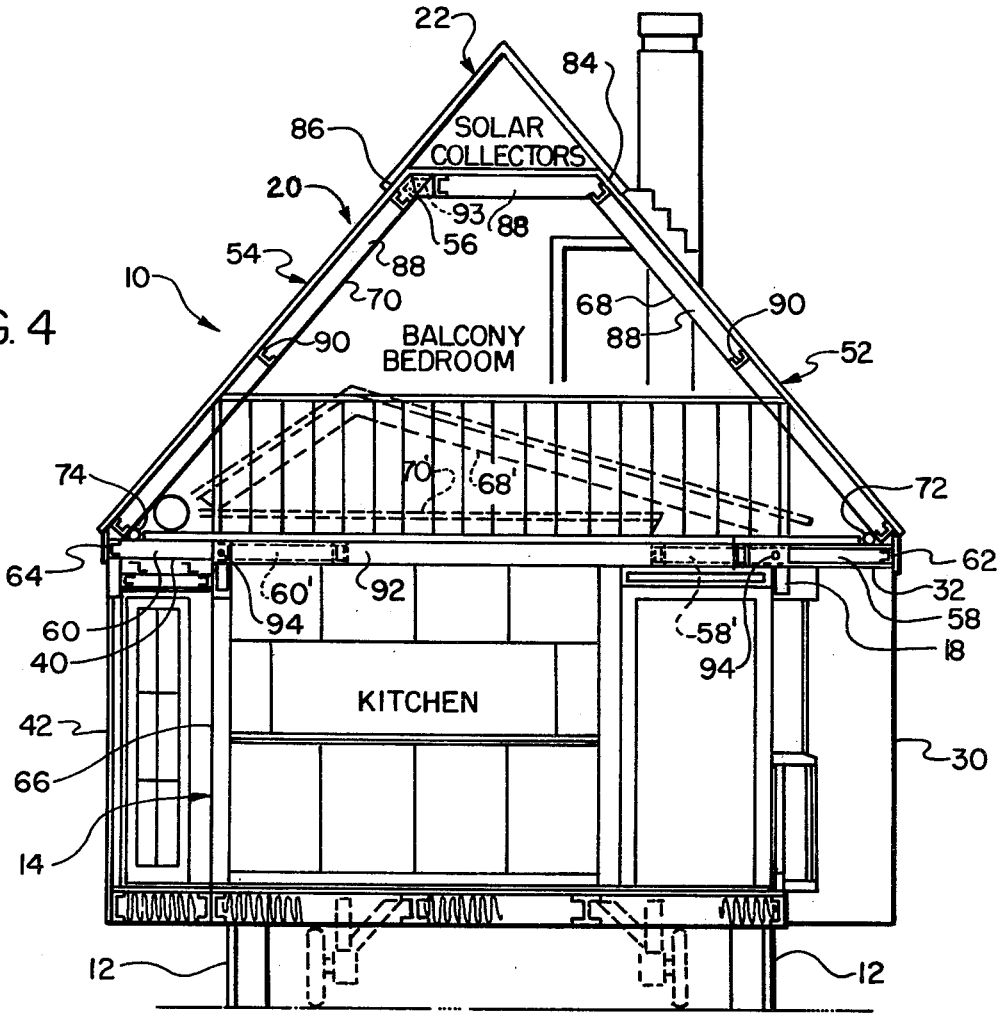

TRANSPORTABLE-EXPANDABLE MOBILE HOME STRUCTURE

BACKGROUND OF THE INVENTION

Mobile homes have become a preferred type of relatively inexpensive housing because they allow a maximum amount of prefabrication in the ideal working conditions of a factory. However, mobile homes have been limited in size by laws governing the size of loads transportable on the highways. Therefore, most mobile homes have been limited in height and width, and tend to be long and narrow with flat roofs and little visual architectural appeal. In some cases, two long narrow halves are transported separately and joined together on a building site to form a more conventional floor plan, but even in these cases relatively flat roofs are the usual rule, and it is somewhat difficult to join together the two halves.

The prior art is replete with folding and telescoping walls and roofs for the expansion of highway transportable units into livable quarters of various sizes and shapes. However, most of the prior art is devoted primarily to generally utiliterian purposes of temporary housing and, as a result, these prior art units have little aesthetic appeal. In some prior art units, such as Loughlin U.S. Pat. No. 3,862,526, aesthetically pleasing structures are provided, but such units generally include relatively complex mechanical arrangements for expanding the size thereof, whereby difficulties may be encountered by the user in carrying out the steps necessary to expand the unit from its highway transportable form to its expanded form.

The mobile home of the present invention offers all the advantages of mass production factory construction, transportability, and expansion into reasonable living space similar to the prior art, and also offers the roof line, vertical walls, and generally pleasing appearance and proportions of well designed conventional houses and would give no hint of its transportability when set on conventional underpinning walls. Also, the mobile home of the present invention provides a mechanical arrangement for expanding the size of the mobile home with relatively little difficulty so that such expansion can generally be accomplished by the owner of the mobile home without the need for technical assistance. The present invention provides for livable space on two stories, and provides expansion units under the roof structure for more conventional width-to-length floor plan proportions as well as additional living and working space. An advantageous roof structure provides a convenient location for a solar energy collector which completes and blends into the roof shape. The finished house could fit into any community as an example of sound fundamental and aesthetically pleasing architecture.

SUMMARY OF THE INVENTION

The present invention provides a mobile home for retracted transport and expanded occupancy which includes a body portion of highway transportable width having side walls and end walls surmounted by a roof structure that includes two roof portions. Each roof portion has a first element mounted for transverse movement with respect to the body portion between a retracted position at which an extending end is adjacent the side walls of the body portion and an extended position at which the extended end is outwardly beyond the side walls to form an eave. A second element of each of each roof portion is arranged for pivotal movement between a first position folded in overlapping relation to lie generally flat across the body portion at the retracted position of the first element, and a second position at which the other, extending, ends of the second elements are joined to one another at a location spaced above the body portion to form a raised roof configuration at the extended positions of the first elements.

Preferably, the mobile home of the present invention has at least one expansion unit selectively mounted beneath one of the eaves of the roof structure contiguous to the outside of the body portion for the expanded occupancy, and the unit is suspended from at least one of the first roof structure elements adjacent its extending end in its extending position. A transverse element of the expansion unit is fixed adjacent the top of the unit, and an adjustable connecting means fastens the transverse element and the extending end of the first roof structure element for suspending the contiguously placed unit adjacent an opening included in the body portion side walls to provide access to the expansion unit.

In the preferred embodiment of the invention, a plurality of expansion units are selectively mounted beneath the eaves, the expansion units respectively taking the form of a bay window, a closet, a bath, and a utility room; and the preferred dimensions of an expansion unit permit it to be received within the body portion for transort. In the preferred embodiment, the second roof structure elements are shaped to form a truncated ridge roof structure when joined to one another, and a detachable elongated roof peak portion houses a solar energy collector and is mounted atop the truncated structure. The roof peak portion is exteriorly glazed and overlaps portions of the roof structure adjacent and beyond its truncation.

BRIEF DESCRIPTION OF THE DRAWINGS

FIG. 4. is a cross-sectional elevational view of the mobile home taken at the line 4—4 of FIG. 2;

FIG. 5. is an elevational cross-sectional view of the mobile home as taken at the line 5—5 of FIG. 3.

DESCRIPTION OF THE PREFERRED EMBODIMENTS

Figure 1:
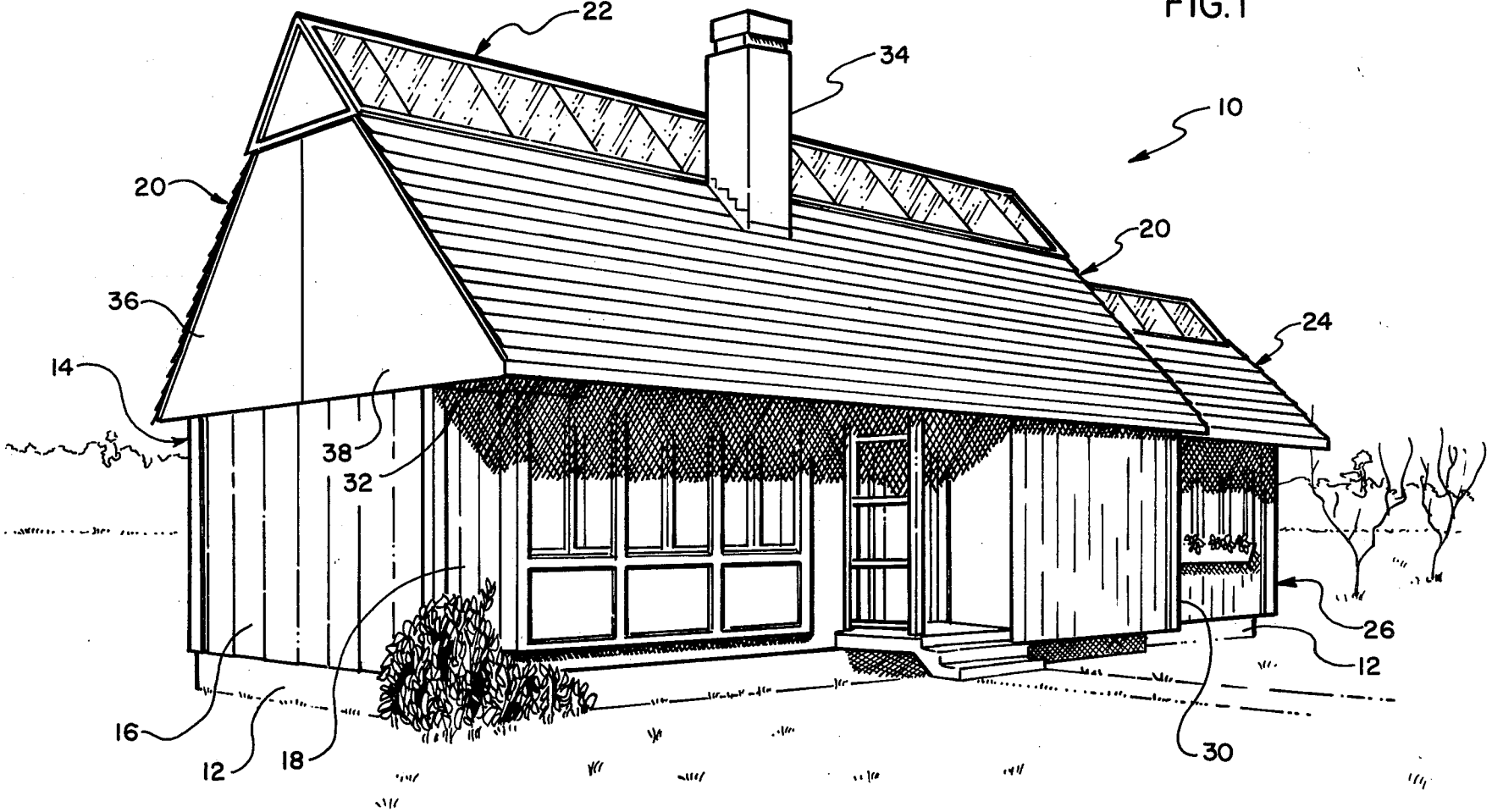
FIG. 1. is a perspective view of a mobile home according to the present invention showing the front or entrance side and the left end in a fully expanded and assembled condition and set on permanent underpinnings on a conventional building lot.

As shown in FIG. 1, a mobile home 10 according to the present invention rests on underpinnings or foundation walls 12 which are conventional and form no part of the present invention. A body portion 14 of the home 10 has a highway-transportable width as shown at its left end wall 16 and its front side wall 18. The walls are surmounted by a roof structure 20 shown in its fully expanded raised roof configuration which overhangs the front and rear side walls of the body portion 14. A detachable elongated roof peak portion 22 is mounted atop the roof structure 20 and houses a conventional solar energy collector. A similar smaller roof structure 24 surmounts a somewhat narrower extension 26 of the body portion 14 at the right end of the home 10.

A closet expansion unit 30 is shown mounted beneath the overhang or front eave 32 of the roof structure 20, and a prefabricated chimney structure 34 is mounted on the roof structure 20. Detachable panels 36 and 38 close off the left gable end of the roof structure.

Figure 2:
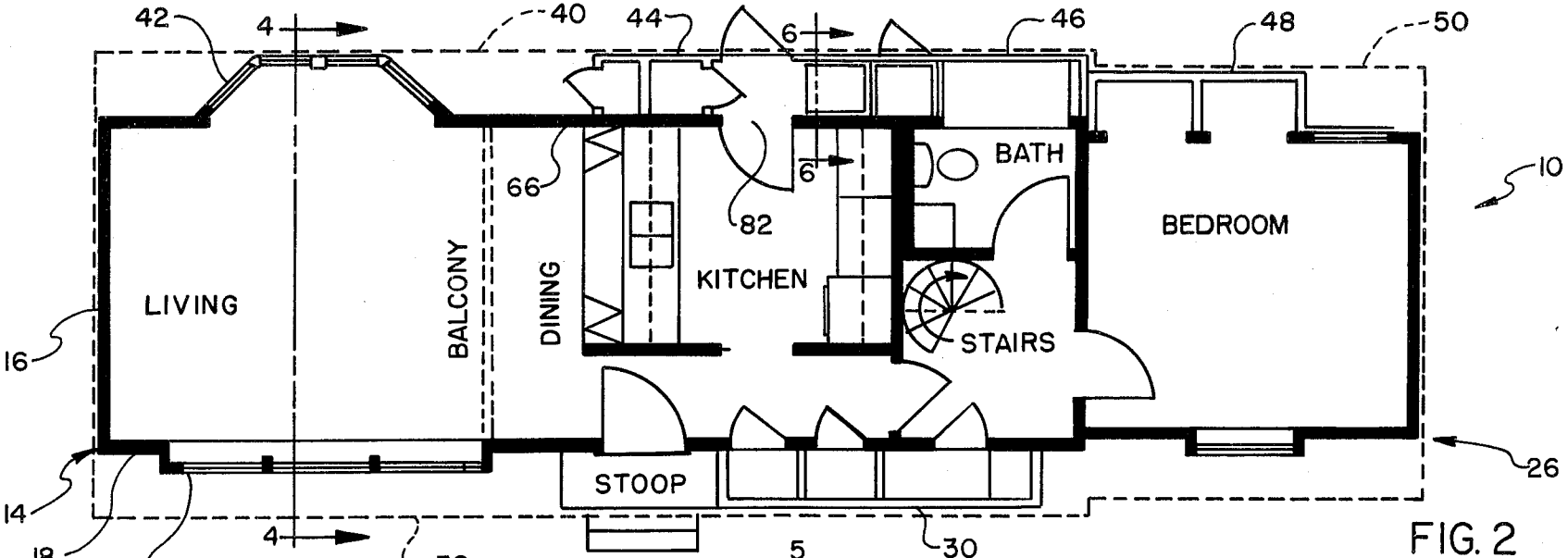
FIG. 2. is a floor plan of the first floor of the mobile home of FIG. 1 showing the expansion units in place.

The floor plan of the home 10 in its expanded occupancy configuration as shown in FIG. 2 shows the extent of the rear eave 40 in broken lines, and, similarly, the front eave 32. Mounted under the rear eave 40 are a bay window expansion unit 42, a storage and utility closet expansion unit 44, a tub-shower expansion unit 46, as well as a bedroom closet expansion unit 48 mounted under the rear eave 50.

The cross-sectional view of the home 10 as shown in FIG. 4 illustrates a front roof portion 52 and a rear roof portion 54 in expanded occupancy configuration, joined together at a detachable joint 56. Each roof portion 52, 54 has a first element 58, 60, respectively, mounted for transverse movement with respect to the body portion 14 between a retracted position as indicated by the broken line positions shown at 58' and 60' respectively, at which the extending ends 62, 64 respectively thereof are adjacent the front side wall 18 and the rear side wall 66 respectively of the body portion 14 (as best seen in FIG. 5), and extended positions (as best seen in FIG. 4) at which the extending ends 62, 64 are outwardly beyond the side walls 18 and 66 to form front and rear eaves 32, 40 respectively.

The roof portions 52, 54 have second elements 68, 70, respectively, pivotably connected at one end thereof to the extending ends 62, 64, of the first elements 58, 60 by hinges 72, 74. The second elements 68, 70 are arranged for pivotal movement between first positions (as indicated in broken lines by the numerals 68' and 70' in FIG. 4) folded in an overlapping relation to lie generally flat across the body portion 14 at the retracted positions 58', 60', of the first elements 58, 60, and a second position as shown in solid lines in FIG. 4, at which the extending ends of the second elements 68, 70 are joined to one another at the joint 56 spaced above the body portion 14 to form a raised roof configuration, with the first elements 58, 60 being at their extended positions, all as shown in solid lines in FIG. 4.

Figure 6:
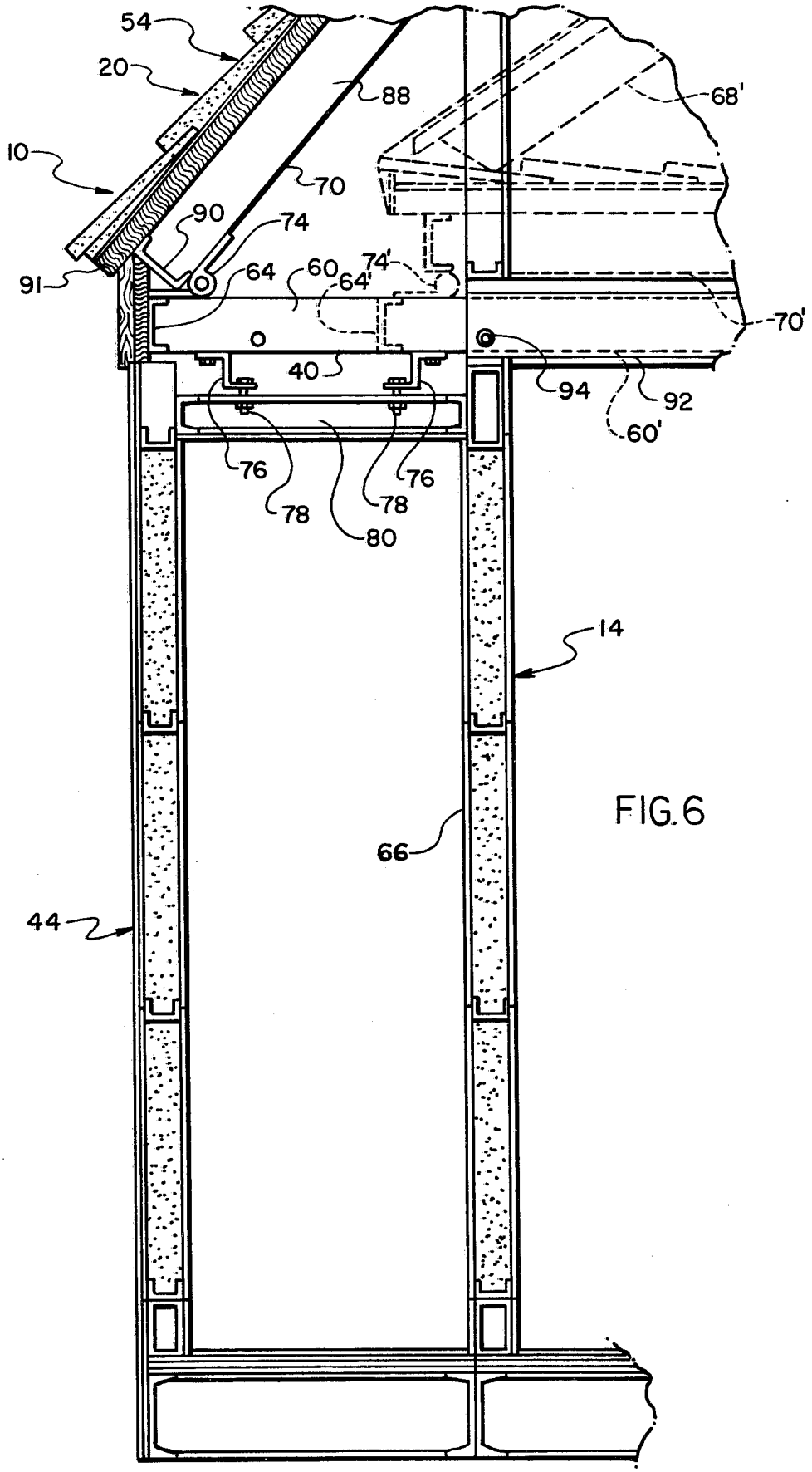
FIG. 6. is a partial elevational cross-sectional view of the mobile home as taken at the line 6—6 of FIG. 2 showing constructional details .

As best seen in FIG. 6, a typical expansion unit such as the storage and utility closet expansion unit 44 has been selectively mounted beneath the rear eave 40 of the roof structure 20 contiguous to the outside of the body portion 14 for expanded occupancy. The expansion unit 44 may be suspended from at least one of the first roof portion elements 60 adjacent the extending end 64 thereof in the extended position thereof as shown in FIG. 6 by adjustable connecting means formed by the Z-shaped brackets 76 which are bolted to the underside of the first element 60 and have threaded connections 78 between the brackets 76 and a transverse element 80 associated with the expansion unit 44 and fixed thereto adjacent the top thereof.

As best seen in FIG. 2, an opening 82 included in the rear side wall 66 of the body portion 14 adjacent the expansion unit 44 provides access thereto. Typically, other similar openings are provided in the front and rear side walls 18 and 66 for the other typical expansion units selectively mounted beneath the eaves 32 and 40, such as the previously mentioned closet, bay window, tub-shower or bath, and bedroom closet expansion units 30, 42, 46 and 48, respectively, all of such expansion units being mounted in place in the same manner as that described above in connection with expansion unit 44. The expansion units may have dimensions permitting them to be received within the body portion 14 for transport, and if necessary, may be made in detachable parts to insure that they will fit within the confines of the body portion of the mobile home.

The second roof elements 68 and 70 form a truncated ridge roof structure when joined to one another at the joint 56 (as best seen in FIG. 4), with the roof portions 52 and 54 forming weather-tight slanted portions of the truncated ridge roof structure, and the detachable elongaed roof peak portion 22 is mounted atop the truncated structure and houses a conventional solar energy collector. The roof peak portion 22 is exteriorly glazed and overlaps the slanted portions of the roof structure adjacent and beyond the truncation thereof as indicated by the numerals 84 and 86.

Figure 3:
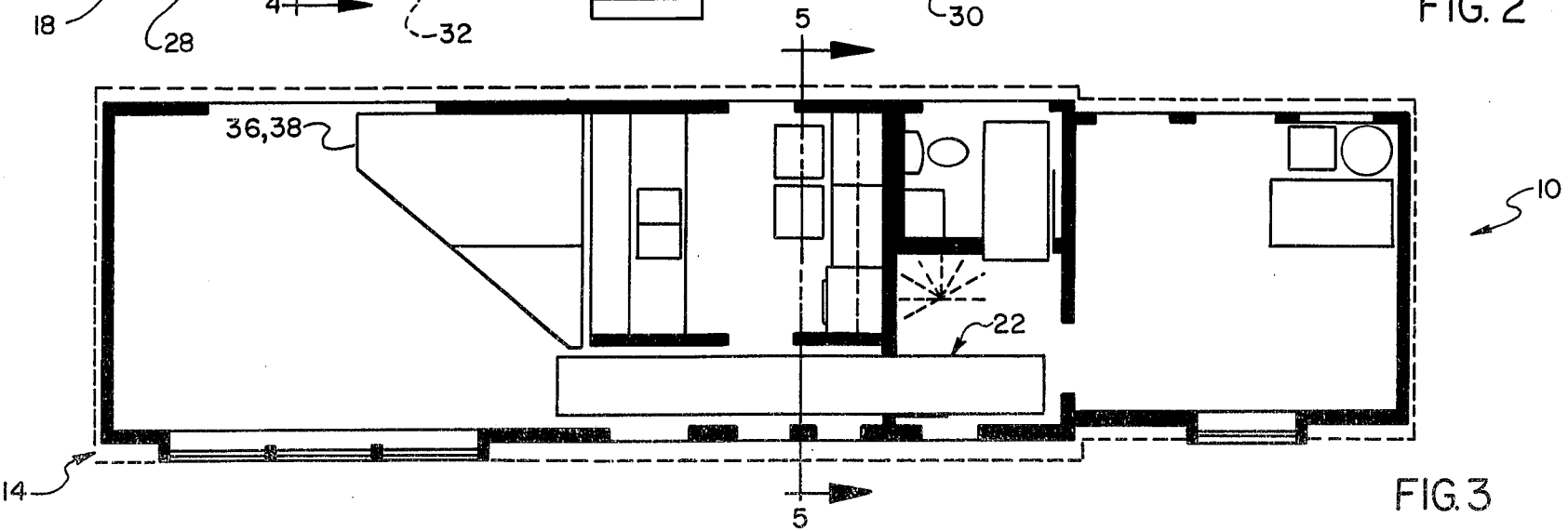
FIG. 3. is a floor plan of the mobile home in its contracted, transport condition.

As shown in FIG. 3, the detachable roof portion 22, the detachable panel gable ends 36, 38 and the appliances and plumbing fixtures may all be carried inside the body portion 14 for the retracted transport of the mobile home 10, and they may then be relocated to their utilitarian positions for the expanded occupancy configuration as shown in FIG. 2 when the mobile home is located on-site. The floor plan shown may be suitably changed as desired by the customer or the manufacturer.

The rafters 88 of the roof portions 52, 54 may typically be formed from 3"×5" rectangular metal tubes connected together by metal channel-shaped purlins 90 suitably spaced, and the frame structure formed by the rafters and purlins may typically be covered by structural insulating board 91 and a conventional plastic, composition, or metal roof thereover on the exposed portions thereof. The roof portions 52 and 54 are hinged to the first elements 58, 60 by hinges 72, 74 which may be continuous along the roof structure or spaced at intervals. The first elements 58, 60 are typically formed from light steel framing beam members spaced two feet on centers lengthwise of the body portion 14 and tesescopically received within light steel framing ceiling joists 92. The joint 56 is typically formed by a tie plate 93 bolted to the joining ends of the rafters 88. Lock pins 94 extend through holes suitably formed in the first elements 58, 60 and the joints 92 to selectively lock the first elements to the body 14 at the retracted and expanded positions of the first elements 58, 60.

The basic structural system, including the floor frame, exterior wall frame, ceiling and second floor frame, and roof frame, is designed for the use of light metal and structural steel components with aluminum framing as an alternative, and all outside walls are insulated. The peaked roof portion 22 is typically built on a $1\frac{1}{8}$" plywood base on which are mounted focused solar collectors protected by the glazing forming the exterior of the triangular unit, and the solar collector system is designed to supplement the conventional heating and air conditioning system in the mobile home.

Thus, the present invention provides a mobile home which is capable of being arranged in a retracted disposition having dimensions which meet the legal redquirements for highway transport (e.g. height of thirteen feet and eight inches, a width less than fourteen feet) with all of the component parts of the mobile home stored within the confines thereof at its retracted disposition. When the mobile home arrives on-site, it can be readily expanded to provide a handsome and roomy structure embodying aesthetically pleasing contemporary architectural features. Moreover, the task of converting the mobile home from its highway transportable mode to its expanded mode is relatively simple in that it is only necessary to move the telescopically mounted first elements 58, 60 to their expanded positions, pivot the second roof elements 68, 70 to their raised positions and join them with tie plates 93, and then attach the expansion units in place beneath the eaves 32, all as described above. The detachable roof peak portion 22 may then be placed atop the roof structure 20.

The present invention has been described in detail above and illustrated in the drawings for disclosure purposes only, and this disclosure is not intended to limit the scope of the present invention, which is to be determined by the scope of the appended claims, and is intended to encompass a full range of constructional equivalents.

I claim:

1. A mobile home for retracted transport and expanded occupancy, said mobile home including a body portion of highway-transportable width and having side walls and end walls surmounted by a roof structure, said roof structure including two roof portions, each roof portion having a first element mounted for transverse movement with respect to said body portion between a retracted position at which an extending end thereof is adjacent said walls of said body portion and an extended position at which said extending end thereof is outwardly beyond said side walls to form an eave, and having a second element pivotably connected at one end thereof to said first element adjacent said extending end thereof, said second element being arranged for pivotal movement between a first position folded in an overlapping relation to lie generally flat across said body portion at said retracted position of said first element and a second position at which the other, extending, ends of said second elements are joined to one another at a location spaced above said body portion to form a raised roof configuration at said extended positions of said fist elements, said mobile home additionally including at least one expansion unit selectively mounted beneath one said eaves of said roof structure and contiguous to the outside of said body portion for said expanded occupancy.

2. A mobile home according to claim 1 and characterized further in that said expansion unit is suspended from at least one of said first elements adjacent said extending end thereof in its extended position.

3. A mobile home according to claim 2 and characterized further by a transverse element associated with said expansion unit and fixed adjacent the top thereof and adjustable connecting means fastening said transverse element and said extending end of said first element for said suspending of said expansion unit.

4. A mobile home according to claim 1 and characterized futher in that said body portion side walls include an opening adjacent said contiguously placed expansion unit to provide access thereto.

5. A mobile home according to claim 1 and further characterized in that a plurality of said expansion units are selectively mounted beneath said roof structure eaves, said expansion units being in the form, respectively, of a bay window, a closet, a bath and a utility room.

6. A mobile home according to claim 1 and characterized further in that said second roof elements are shaped to form a truncated ridge roof structure when joined to one another, and in that a detachable elongated roof peak portion housing a solar energy collector is mounted atop said truncated structure.

7. A mobile home according to claim 1 and characterized further in that said roof peak portion is exteriorly glazed and overlaps portions of said roof structure adjacent and beyond said truncation thereof.

* * * * *

UNITED STATES PATENT OFFICE

CERTIFICATE OF CORRECTION

Patent No. 4,180,949 Dated Jan. 1, 1980

Inventor(s) Earle S. Draper, Jr.

It is certified that error appears in the above-identified patent and that said Letters Patent are hereby corrected as shown below:

Column 2, line 2, delete "each of." Column 2, line 17, before "position" delete "extending" and insert therefor --extended--. Column 2, line 31, delete "transort" and insert therefor --transport--. Column 4, lines 16 and 17, delete "elongaed" and insert therefor --elongated--. Column 4, line 23, after "roof" insert --peak--. Column 4, lines 45 and 46, delete "tesescopically" and insert therefor --telescopically--. Column 4, line 50, delete "joints" and insert --joists--. Column 4, line 54, delete "frame," second occurrence, and insert therefor --frames--. Column 4, lines 66 and 67, delete "redquirements" and insert therefor --requirements--. Column 5, line 32, before "walls" insert --side--. Column 6, line 36, delete "1" and insert therefor --6--.

Signed and Sealed this

*Tenth* Day of *June 1980*

[SEAL]

*Attest:*

SIDNEY A. DIAMOND

*Attesting Officer*

*Commissioner of Patents and Trademarks*